US005862536A

United States Patent [19]

Huang

[11] Patent Number: 5,862,536

[45] Date of Patent: Jan. 26, 1999

[54] TOILET TANK HAVING ARTICLES HOLDING SLOT

[76] Inventor: Sen-Don Huang, No. 16, Tunnel 175, How Jing Dong Road, Kaohsiung, Taiwan

[21] Appl. No.: 504,448

[22] Filed: Jul. 20, 1995

Related U.S. Application Data

[63] Continuation-in-part of Ser. No. 271,328, Jul. 6, 1994, abandoned.

[51] Int. Cl.[6] ..... E03D 1/00

[52] U.S. Cl. ..... 4/353; 4/661

[58] Field of Search ..... 4/300.1, 340, 341, 4/342, 353, 363, 364, 365, 661; D23/301, 313

[56] References Cited

U.S. PATENT DOCUMENTS

| | | | |
|---|---|---|---|
| D. 270,936 | 10/1983 | Everson | 4/353 X |
| 2,099,932 | 11/1937 | Isaacson | 4/353 |
| 2,749,968 | 6/1956 | Suser | 4/661 |

FOREIGN PATENT DOCUMENTS

| | | | |
|---|---|---|---|
| 0269739 | 10/1950 | Switzerland | 4/341 |

*Primary Examiner*—Robert M. Fetsuga

*Attorney, Agent, or Firm*—Raymond Yat Chan; David & Raymond

[57] ABSTRACT

The present disclosure relates to a toilet tank having articles holding slot which comprises a rectangular toilet tank for the flushing of toilet and a toilet tank cover for covering the toilet tank. A right wing and a left wing extend backwardly from and perpendicularly to a back wall of the toilet tank respectively. A bottom support is horizontally connected between the right and left wings so as to incorporate with the right and left wings and the back wall to form a rigid "I" shaped construction that can resist transverse and longitudinal stress with the minimum parts and constructing material and the minimum manufacturing cost. Thus, the bottom support and the upper portions of the back wall, the right wing and the left wing define a receiving room therebetween. Whereby, the toilet tank is mounted to a vertical bathroom wall that acts as another side wall of the receiving room so that an article holding slot is formed for storing articles, such as newspapers, books and magazines, or toilet cleaning tools.

4 Claims, 5 Drawing Sheets

TOILET TANK HAVING ARTICLES HOLDING SLOT

This application is a continuation-in-part of application Ser. No. 08,271,328, filed Jul. 6, 1994, abandoned. This CIP application relates to a toilet tank which has an articles holding slot for holding therein various articles such as news papers, magazines, toilet papers, disinfectants, brushes, etc.

BACKGROUND OF THE PRESENT INVENTION

To utilize limited time for absorbing the maximum knowledge becomes a nowadays ideology of human being in today's progressive commercial society. People have to spend a certain period of time on toilet every day. To avoid the wasting of time, people are used to read newspapers or magazines during defecating.

However, it is rarely to provide book shelf or specified place for storing newspapers or magazines in such a narrow and small residential bathroom or public rest room. Generally, people simply place the books, magazines, and newspapers on the cover of toilet tank or on the edge of washbasin where people can easily reach while sitting on the toilet. Since the size of the flat or convex smooth top surface of the toilet tank cover is generally 8×20 inches, objects placed thereon will easily drop or slip off the top surface. Moreover, the paper made articles will easily be damaged due to the damp surface of the washbasin.

Toilet cleaning tools like toilet brush and cleansing acid should be stored in a good ventilating location in the bathroom. So that, they are not suitable to store in the cabinet and have to commonly place on the bathroom floor although they are easily to fall off and unseemly.

Accordingly, an adequate room that does not occupy much area in such narrow and small bathroom for holding those newspapers, books, magazines, or toilet cleaning tools is highly desired.

SUMMARY OF THE PRESENT INVENTION

It is, therefore, the primary objective of the present invention to provide a toilet tank having articles holding slot that utilizes the limited space of toilet tank to provide a holding room with minimum cost and parts for storing articles like books, newspapers, and magazines, or toilet cleaning tools.

It is still another objective of the present invention to provide a toilet tank having articles holding slot that provides an adequate room that does not occupy much area in such narrow and small bathroom for holding newspapers, books, magazines, or toilet cleaning tools.

It is still another objective of the present invention to provide a toilet tank having articles holding slot for storing articles like newspapers, books, or magazines that has a shortest distant for a person sitting on the toilet to reach the articles.

It is still another objective of the present invention to provide a toilet tank having articles holding slot for storing toilet cleaning tools which can be held within a good ventilating slot in the bathroom that are not easily to fall off and can maintain a refined cleansing environment.

Accordingly, the present invention provides a toilet tank having articles holding slot which comprises a toilet tank for the flushing of toilet. The toilet tank has a front wall, a right wall, a left wall a back wall, and a bottom wall that incorporate to form a rectangular one-piece body with a top opening. A toilet tank cover which has a size and shape corresponding with the periphery of the top opening is placed on the toilet tank to cover its top opening. A right wing and a left wing extend backwardly from and perpendicularly to the back wall respectively. Each of the right and left wings has a predetermined length shorter than the width of the right and left walls and a triangular cross section. Each of the right and left wings has a reinforced thick root portion incorporating with the back wall and reducing its thickness gradually while extending from the back wall backwardly to form an end portion with a thickness substantially equal to the right and left walls' thickness. Moreover, the right and left wings incorporate with the right and left walls respectively to form a right and a left smooth flat outer surface. Each of the inner sides of the right and left wings is thus defined to form an inner concave curve surface. A bottom support is horizontally connected between the right and left wings so as to incorporate with the reinforced right and left wings and the back wall to form a rigid "I" shaped construction that can resist transverse and longitudinal stress with the minimum parts and constructing material and the minimum manufacturing cost. Thus, the bottom support and the upper portions of the back wall, the right wing and the left wing define a receiving room therebetween.

The toilet tank is installed to a vertical bathroom wall with the right and left end edges of the right and left wings in contact with the bathroom wall. In which, the bathroom wall acts as another side wall of the receiving room to form an article holding slot for storing articles, such as newspapers, books and magazines, or toilet cleaning tools.

The foregoing objectives and device of the present invention can be more readily understood by studying the following detailed description of the present invention in accordance with the drawings provided herewith.

DETAILED DESCRIPTION OF THE PREFERRED EMBODIMENT

Figure 1:
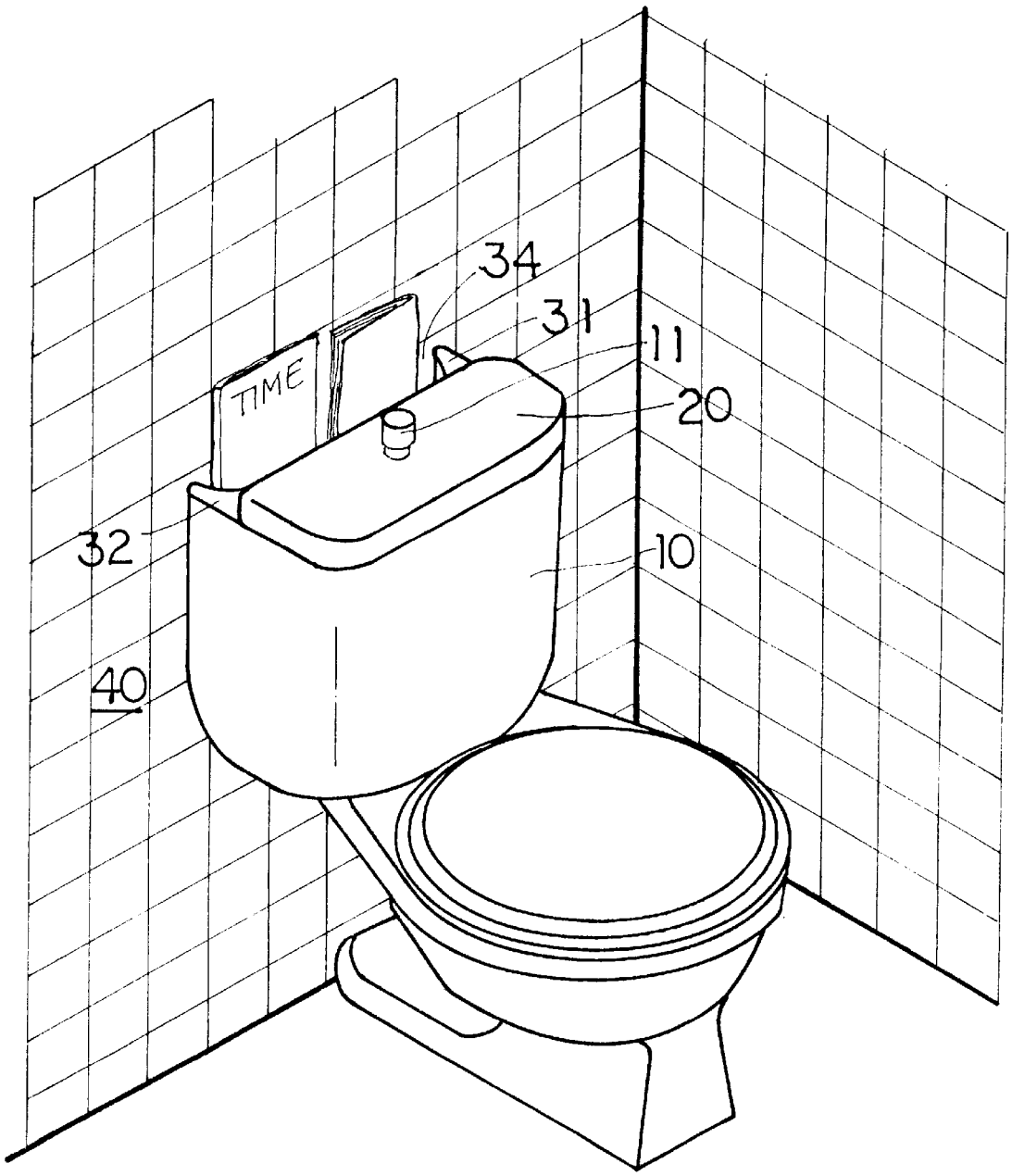
FIG. 1 is an isometric view of a toilet tank having articles holding slot installed to a bathroom wall according to a preferred embodiment of the present invention.
Figure 2:
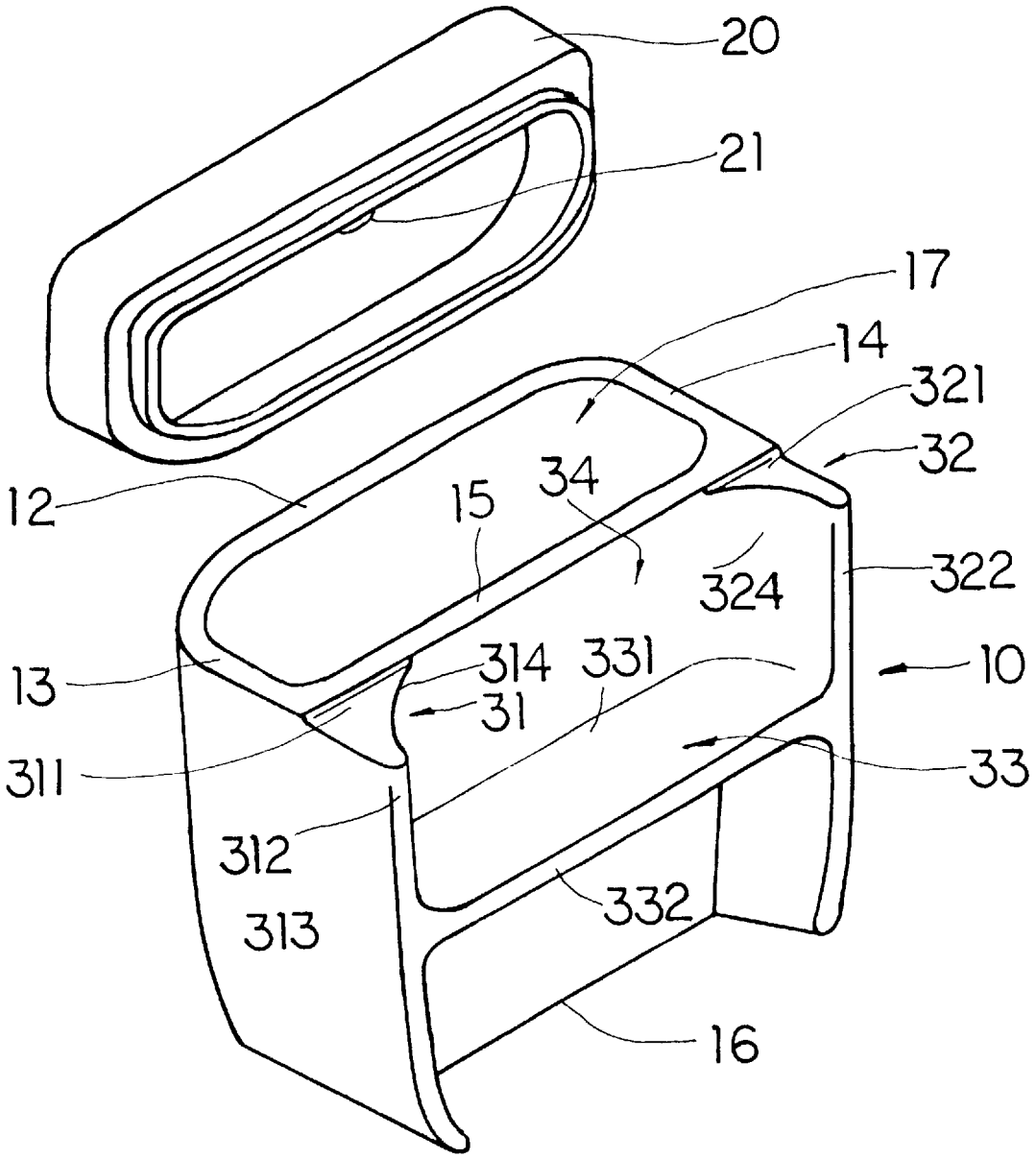
FIG. 2 is a perspective rear view of a toilet tank having articles holding slot according to the above preferred embodiment of the present invention.
Figure 3:
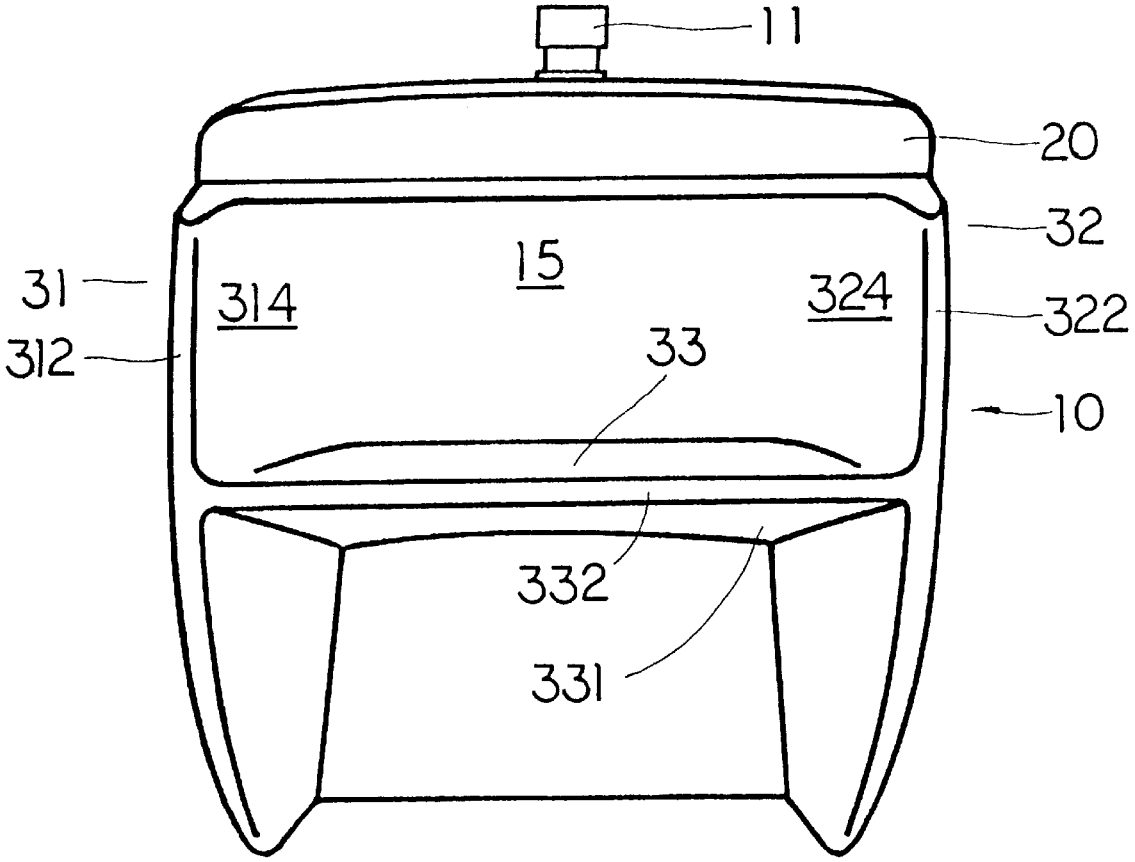
FIG. 3 shows a back view of a toilet tank having articles holding slot according to the above preferred embodiment of the present invention.
Figure 4:
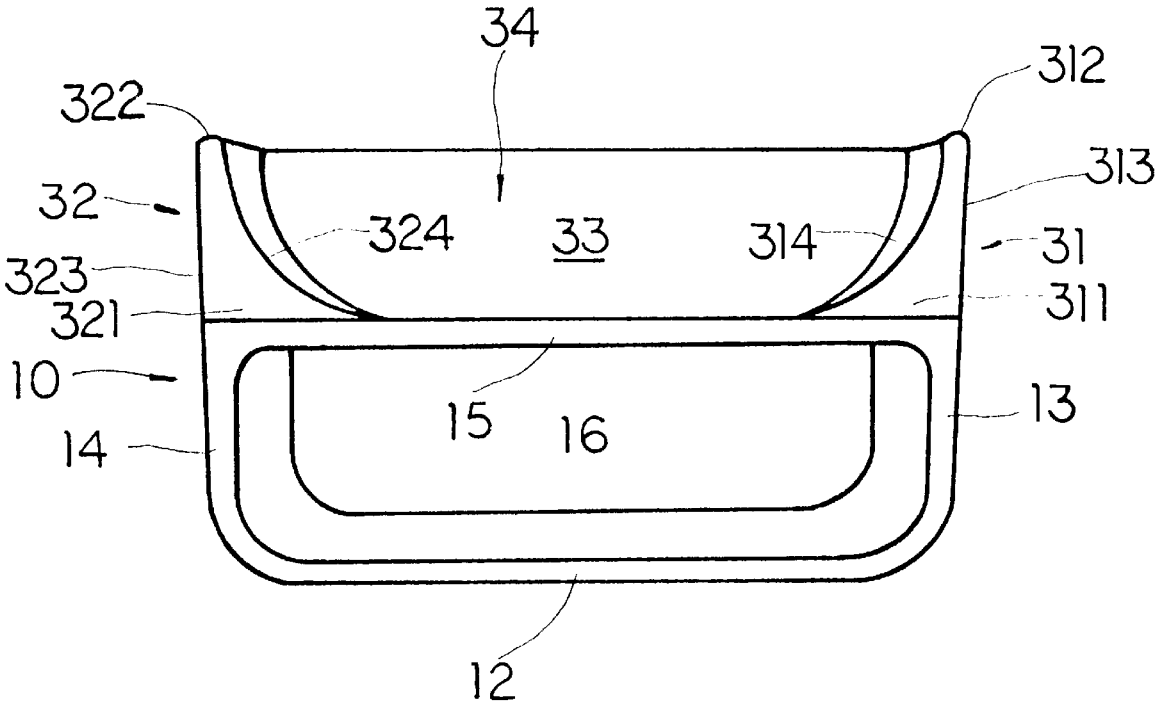
FIG. 4 shows a top view of a toilet tank having articles holding slot according to the above preferred embodiment of the present invention.

Referring FIGS. 1 to 4, a toilet tank having articles holding slot of the present invention comprises a toilet tank which has a conventional toilet flushing device (not shown in the Figures) installed within for the flushing of toilet by pushing or pulling an operating button 11. The toilet tank 10 which is made of cermics or porcelain has a front wall 12, a right side wall 13, a left side wall 14, a back wall 15, and a bottom wall 16 incorporated to form a rectangular one-piece body with a top opening 17.

A toilet tank cover 20 which has a size and a rectangular shape corresponding with the periphery of the top opening 17 is placed on the toilet tank 10 to cover its top opening 17. The toilet tank cover 20 has a button hole 21 on its top surface for installing the operating button 11.

The present invention characterizes in further comprising a right wing 31 and a left wing 32. The right and left wings 31, 32 extend backwardly from and perpendicularly to the back wall 15 respectively. Each of the right and left wings 31, 32 has a predetermined width shorter than the width of the right and left side walls 13, 14 and a triangular cross section. Each of the right and left wings 31, 32 has a reinforced thick root portion 311, 321 incorporating with the back wall 15 and reducing its thickness gradually from the root portion 311, 321 in a perpendicular direction by extending outwardly to form an end portion with a thickness substantially equal to the thickness of the right and left walls 13, 14. So that, the right and left wings 31, 32 incorporate with the right and left walls 13, 14 respectively to form a right smooth flat outer surface 313 and a left smooth flat outer surface 323. Each of the inner sides of the right and left wings 31, 32 is thus defined to form an inner concave curve surface 314, 324.

A bottom support 33 is horizontally disposed between the middle portions of the right and left wings 31, 32 and is incorporated with the reinforced right and left wings 31, 32 and the back wall 15 to form a rigid "I" shaped construction that can resist transverse and longitudinal stress with minimum parts and constructing material and minimum manufacturing cost. For strengthening the bottom support's 33 supporting strength, the thickened root portion 331 of the bottom support 33, which is connected with the back wall 15, gradually reduces its thickness from the back wall 15 in a perpendicular direction by extending outwardly to form an end edge 332. Therefore, the cross section of the bottom support 33 is in "V" shape. Thus, the bottom support 33 and the upper portions of the back wall 15, the right wing 31 and the left wing 32 incorporate to define a receiving room 34 therebetween.

The intersections of the bottom support 33 with the back wall 15, the right wing 31 and the left wing 32 are in concave shape that can avoid dust gathering and maintain easy sweeping.

Accordingly, as shown in FIG. 1, the toilet tank 10 is mounted to a vertical bathroom wall 40 with the right and left end edges of the right and left wings 31, 32 in contact with the bathroom wall 40. The bathroom wall 40 acts as another side wall of the receiving room 34 so that the receiving room 34 incorporates with the bathroom wall 40 to form an article holding slot storing articles, such as newspapers, books and magazines, or toilet cleaning tools.

Figure 5:
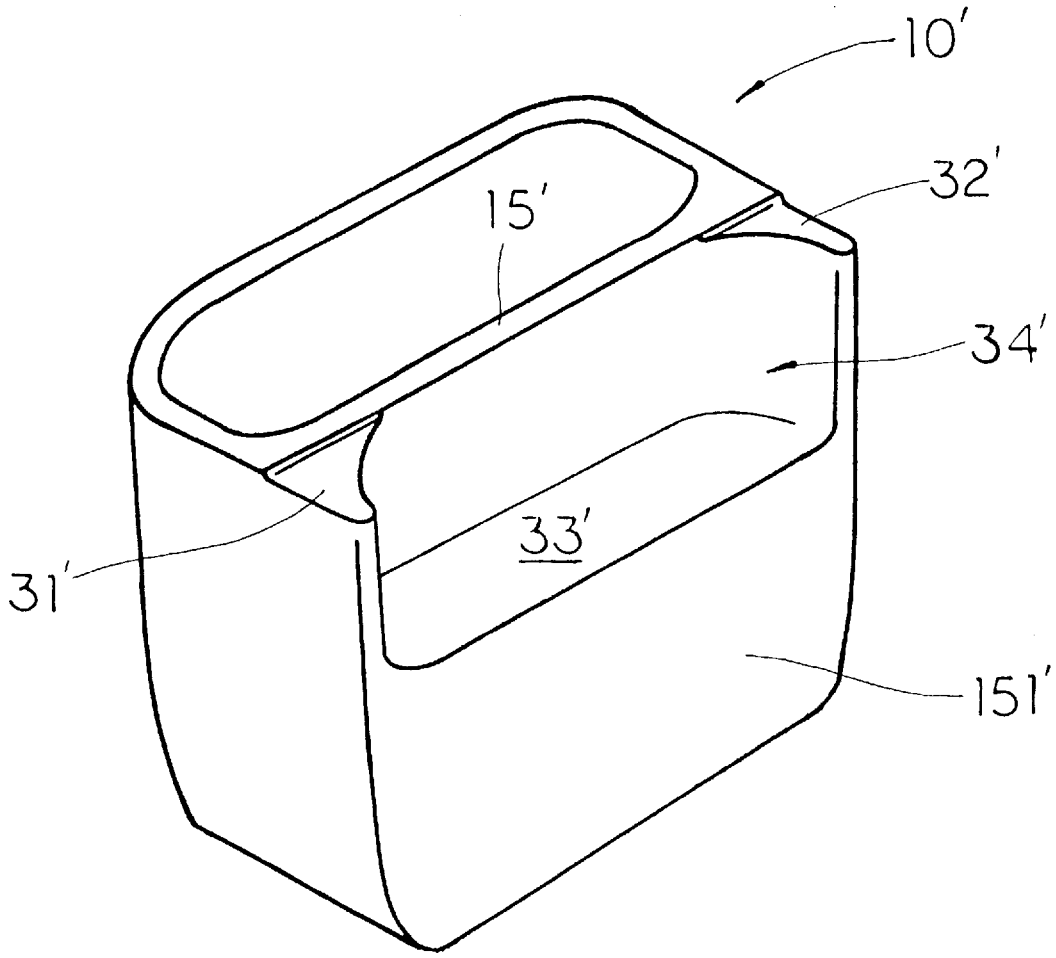
FIG. 5 shows a perspective rear view of a toilet tank having articles holding slot according to another embodiment of the present invention.

Referring to FIG. 5, an alternative embodiment of the present invention is illustrated. The toilet tank 10 also provides a receiving room 34' for storing articles and toilet cleaning tools by incorporating with a right wing 31', a left wing 32', a bottom support 33', and a back wall 15'. The lower portion 151' of the back wall 15' underneath the receiving room 34' is disposed in a position connecting to the end portions of the right wing 31', the left wing 32' and the bottom support 33' in order to increase the water capacity of the toilet tank 10'.

In accordance with the above recited description of a toilet tank having articles holding slot of the present invention utilizes the limited space of toilet tank to provide a holding room with minimum cost and parts for storing articles like books, newspapers, and magazines, or toilet cleaning tools which can be held within the good ventilating holding slot to prevent the articles or toilet cleaning tools from falling off and to maintain a refined cleansing environment in bathroom. Furthermore, the receiving room 34 provides an adequate room that does not occupy much area in such narrow and small bathroom. The toilet tank having articles holding slot has a shortest distant for a person sitting on the toilet to reach the articles.

I claim:

1. A toilet tank having articles holding slot for mounting to a vertical bathroom wall, comprising:

a toilet tank which has a front wall, a right wall, a left wall, a back wall, and a bottom wall incorporated to form a rectangular one-piece body with a top opening;

a toilet tank cover which is placed on said toilet tank to cover said top opening of said toilet tank;

a right wing and a left wing which extend backwardly from and perpendicularly to said back wall respectively; each of said right wing and left wing having a triangular cross section and a reinforced thick root portion which is incorporated with said back wall; each of said right and left wings reducing its thickness gradually from said root portion in a perpendicular direction by extending outwardly to form an end portion with a thickness substantially equal to the thickness of said right and left walls, thus, each of the inner sides of said right and left wings is defined to form an inner concave curve surface; said right and left wings being incorporated with said right and left walls respectively to form a right smooth flat outer surface and a left smooth flat outer surface;

a bottom support which is horizontally disposed between the middle portions of said right and left wings by incorporating with said right wing, said left wings and said back wall to form a rigid "I" shaped construction; said bottom support having a thickened root portion which connects with said back wall and gradually reduces its thickness while from said back wall in a perpendicular direction by extending outwardly to form an end edge; so that said bottom suport and the upper portions of said back wall, said right wing and said left wing define a receiving room therebetween; and whereby said toilet tank is installed to said bathroom wall with said right and left end edges of said right and left wings in contact with said bathroom wall which acts as another side wall of said receiving room to from an article holding slot for storage purposes.

2. A toilet tank having articles holding slot as recited in claim 1, wherein the intersections of said bottom support with the back wall, the right wing, and the left wing are in concave shape that can avoid dust gathering and maintain easy sweeping.

3. A toilet tank having articles holding slot for mounting to a vertical bathroom wall, comprising:

a toilet tank which has a front wall, a right wall, a left wall, a back wall, and a bottom wall incorporated to form a rectangular one-piece body with a top opening;

a toilet tank cover which is placed on said toilet tank to cover said top opening of said toilet tank;

a right wing and a left wing which extend backwardly from and perpendicularly to said back wall respectively; each of said right wing and left wing having a triangular cross section and a reinforced thick root portion which is incorporated with said back wall; each of said right and left wings reducing its thickness gradually from said root portion in a perpendicular direction by extending outwardly to form an end portion with a thickness substantially equal to the thickness of said right and left walls, thus, each of the inner sides of said right and left wings is defined to form an inner concave curve surface; said right and left wings being incorporated with said right and left walls respectively to form a right smooth flat outer surface and a left smooth flat outer surface;

a bottom support which is horizontally disposed between the middle potions of said right and left wings by incorporating with said right wings, left wings and said back wall to form a rigid "I" shaped construction so that said bottom support and the upper portions of said back wall, said right wing and said left wing define a receiving room therebetween; the lower portion of said back wall underneath said receiving room being disposed in a position connecting to said end portions of said right and left wings and said end edge of said bottom support in order to increase the water capacity of said toilet tank; and whereby, said toilet tank is installed to said bathroom wall with said right and left end edges of said right and left wings in contact with said bathroom wall which acts as another side wall of said receiving room to from an article holding slot for storage purposes.

4. A toilet tank having articles holding slot as recited in claim 3, wherein the intersections of said bottom support with the back wall, the right wing, and the left wing are in concave shape that can avoid dust gathering and maintain easy sweeping.

* * * * *